US005152392A

United States Patent [19]

Iwasa

[11] Patent Number: 5,152,392

[45] Date of Patent: Oct. 6, 1992

[54] PUSH SWITCH WITH IMPROVED ACTUATOR ASSEMBLY

[75] Inventor: Seiichi Iwasa, Sagamihara, Japan

[73] Assignee: Fujitsu Limited, Kawasaki, Japan

[21] Appl. No.: 705,650

[22] Filed: May 24, 1991

[30] Foreign Application Priority Data

Jun. 11, 1990 [JP] Japan ..... 2-152206

[51] Int. Cl.[5] ..... H01H 1/10

[52] U.S. Cl. ..... 200/517; 200/341; 200/329; 200/5 A

[58] Field of Search ..... 200/512, 517, 341, 329, 200/5 A, 306, 82 C, 83 R, 83 B, 83 N, 83 Z, 331

[56] References Cited

U.S. PATENT DOCUMENTS

| | | | |
|---|---|---|---|
| 3,978,297 | 8/1976 | Lynn et al. | 200/517 X |
| 4,078,257 | 3/1978 | Bagley | 200/517 X |
| 4,109,118 | 8/1978 | Kley | 200/517 X |
| 4,284,866 | 8/1981 | Bryce et al. | 200/517 |
| 4,300,029 | 11/1981 | Maser | 200/83 N X |
| 4,349,712 | 9/1982 | Michalski | 200/517 X |
| 4,423,294 | 12/1983 | Walser et al. | 200/513 X |
| 4,446,344 | 5/1984 | Fredler | 200/83 B |
| 4,463,234 | 7/1984 | Bennewitz | 200/516 |
| 4,520,248 | 5/1985 | Woelfel | 200/340 |
| 4,598,181 | 7/1986 | Selby | 200/512 X |
| 4,754,107 | 6/1988 | Tracey | 200/83 Z |

FOREIGN PATENT DOCUMENTS

| | | | |
|---|---|---|---|
| 1129210 | 5/1962 | Fed. Rep. of Germany | 200/83 B |
| 2412931 | 10/1975 | Fed. Rep. of Germany | 200/83 B |
| 60-127619 | 7/1985 | Japan . | |
| 206906 | 8/1966 | Sweden | 200/83 B |

*Primary Examiner*—Henry J. Recla
*Assistant Examiner*—Glenn T. Barrett
*Attorney, Agent, or Firm*—Staas & Halsey

[57] ABSTRACT

A push switch includes a support, a switching-element assembly arranged on the support, and an actuator assembly arranged on the switching-element assembly. The switching-element assembly includes first and second contacts vertically arranged, with the second contact being elastically movable toward the first contact and making contact with the first contact when depressed by the actuator assembly. The basic actuator assembly includes an airtight enclosure of an elastic film having a domed shape and a gas enclosed therein, so that the bottom surface of the airtight enclosure depresses the second contact by a depression force onto the top surface thereof.

31 Claims, 9 Drawing Sheets

PUSH SWITCH WITH IMPROVED ACTUATOR ASSEMBLY

BACKGROUND OF THE INVENTION

1. Field of the Invention

The present invention relates to a push switch for opening and closing an electronic circuit and an improvement thereof, particularly to a push switch with an improved actuator assembly applied for a keyboard having a light weight and a compact structure.

With advances in information processing apparatus in recent years, a push switch plays a more important role in these apparatus as a communication tool with an operator. The push switches are required to be more compact, lighter in weight and smaller in height, and further to have a more comfortable feel in the depressing operation of the push switch. Due to increased applications in transportable OA (office automation) apparatus, requirements for a more comfortable feeling a low profile and light weight have become stronger.

2. Description of the Related Art

Generally, a push switch is composed of a switching-element assembly which opens and closes an electronic circuit, and an actuator assembly for transmitting a depression action by a finger to the switching-element assembly. As the switching-element assembly of the push switch, many types are known and utilized including a lead switch, mechanical switch, membrane switch, conductive rubber switch, etc., and selectively utilized in accordance with the specific application.

FIGS. 1, 2(*a*) and 2(*b*) show an exemplary structure of a switching-element assembly 100 known as a membrane sheet type switch, which is used in a low profile keyboard. FIG. 1 is a perspective view and FIGS. 2(*a*) and 2(*b*) are cross sections.

In FIG. 1, the switching-element assembly 100 comprises an upper sheet 111*a* and a lower sheet 111*b* of a flexible film of polyester or the like, having respective wiring patterns 113*a* and 113*b* and a plurality of contacts 110*a* and 110*b*, which are printed thereon using an ink of Ag (silver) or C (carbon). A spacer 112 has holes at the corresponding positions to the contacts 110*a* and 110*b* when these sheets are stacked together.

FIGS. 2(*a*) and 2(*b*) show two different states of the switching-element assembly 100, in which FIG. 2(*a*) indicates an off-state of the contacts and FIG. 2(*b*) indicates an on-state thereof when two contacts 110*a* and 110*b* are closed by a depression force onto the push switch.

FIG. 3(*a*) shows an overall cross section of an exemplary structure of a push switch (also called a push-button switch) of the prior art including a switching-element assembly 100 of the membrane sheet type. The push switch further comprises a support panel 200 of iron or the like, and the switching-element assembly 100 is disposed thereon. A housing 4 is disposed on the switching-element assembly 100, a slider 3 is arranged movable in a hole 40 of the housing 4, and a key-top 2 is fixed on the slider 3. Two springs 70 and 80 are arranged for obtaining a comfortable key-touch feeling when the key-top 2 is depressed by a finger. A key-bottom 5 which is fixed at the end of the spring 80 depresses the switching-element assembly 100 and makes a contact between two contacts 110*a* and 110*b* as previously explained. In this type of push switch, all constituent parts disposed on the switching-element assembly play a role of an actuator assembly for the push switch.

FIG. 3(*b*) shows a cross section of another example of a push switch of the prior art. The difference between the structures of FIG. 3(*a*) and FIG. 3(*b*) is that the latter type of the push switch comprises only one spring 80 and an additional elastic member 50 made of a rubber sheet having a spherical shape portion protruding toward the bottom of a slider 3. The elastic member 50 has a protrusion 50*a* at the center of the inside wall surface, and the protrusion 50*a* functions as the key-bottom 5 in FIG. 3(*a*). The push switch of FIG. 3(*b*) gives a comfortable snap feeling when the contacts are closed. The actuator assembly of FIG. 3(*b*) is in a broad sense composed of an actuator assembly 50 in a narrow sense and a slider assembly including slider 3, housing 4, key-top 2, spring 80, etc.

Generally speaking, it is known that a key-top stroke length of about 3 to 4 mm is preferable for obtaining the comfortable key-touch feel, and a slider length (length L shown in FIG. 3(*a*)) of about 12 mm is required in order to obtain a smooth movement of the slider without shake. Even if smaller dimensions are used, an overall height of the push-button switch, which includes support panel 200, switching-element assembly 100, and the actuator assembly such as shown in FIGS. 3(*a*) and 3(*b*), requires at least about 10 mm.

In contrast, a switch element having a short stroke length such as about 1 mm to 2 mm has been put into practical application sacrificing the comfortable key-touch feel. However, with regard to the push switches used in an input apparatus which is in frequent use, it is not appropriate to sacrifice the key-touch feel.

Further, in the existing push-button switches such as shown in FIGS. 3(*a*) and 3(*b*), most of the constituent parts are made of plastic material such as ABS resin, and the weight of the actuator including the slider assembly comprising housing, slider, key-top, spring, etc. is about 60% of the overall weight of the push switch. A weight increase is partly due to the fact that the stroke length is large in order to obtain the comfortable key-touch feel.

On the other hand, in an application of the push switch into transportable apparatus which requires a low profile and a light weight, the push switch having a stroke length of about 1 mm to 2 mm without spring 70 shown in FIG. 3(*a*) has been utilized. In this type, there is a problem of contact error, in which a push switch will not make a contact when the key-top is depressed with a light finger touch, because the contacts are closed only when the key-top is depressed to the downward bottom position (collide operation). Therefore, in an application for a keyboard in which a plurality of push switches are used, frequent input errors are experienced and re-input operation is required.

In order to obtain a low profile push switch using switching-element assembly of the membrane sheet type, several types of push switches have been disclosed. Among them, Japanese Unexamined Patent Publications SHO 57-55020 opened Apr. 1, 1982 (same as U.S. Pat. Ser. No. 4,520,248 filed Aug. 15, 1980) discloses that a sheet of elastic foaming material is utilized as an actuator assembly disposed on a membrane type switching-element assembly. Further, SHO 60-127619 opened Jul. 8, 1985 discloses that an actuator assembly composed of a convex-shaped transformable sheet and a planar sheet joined together at the periphery of the above convex-shape, both being of plastic material, are used as an actuator for obtaining a comfortable click feeling. In the above two disclosures, no slider assembly is used for obtaining a low profile of the push switch.

SUMMARY OF THE INVENTION

A general object of the present invention is to provide a push switch having a low profile and a light weight by a simple structure.

Another object of the present invention is to provide a push switch having a comfortable key-touch feel in depressing the push switch.

Still another object of the present invention is to provide a push switch which closes the switching-element halfway during a depressing action onto the top of the push switch.

Still a further object of the present invention is to provide a push switch, in which an actuator assembly thereof is easily replaced with another actuator assembly.

A push switch of the present invention comprises a support, a switching-element assembly arranged on the support, and an actuator assembly arranged on the switching-element assembly, wherein the switching-element assembly is of a membrane sheet type and comprises first and second contacts vertically arranged, the second contact being elastically movable toward the first contact and making contact with the first contact when depressed by the actuator assembly.

The special feature of the present invention is characterized in the structure of the actuator assembly, in which the actuator assembly comprises an airtight enclosure of an elastic film having a domed shape and a gas enclosed or sealed therein, whereby the bottom surface of the airtight enclosure depresses the switching-element assembly performing a switching action. Several modified versions of the actuator assembly are disclosed, and the actuator assembly of the present invention further includes a slider assembly for obtaining an easy depressing action by a finger.

BRIEF DESCRIPTION OF THE DRAWINGS

Throughout the drawings, the same reference numerals designate and identify the same or the similar parts.

DETAILED DESCRIPTION OF THE PREFERRED EMBODIMENTS

Figure 1:
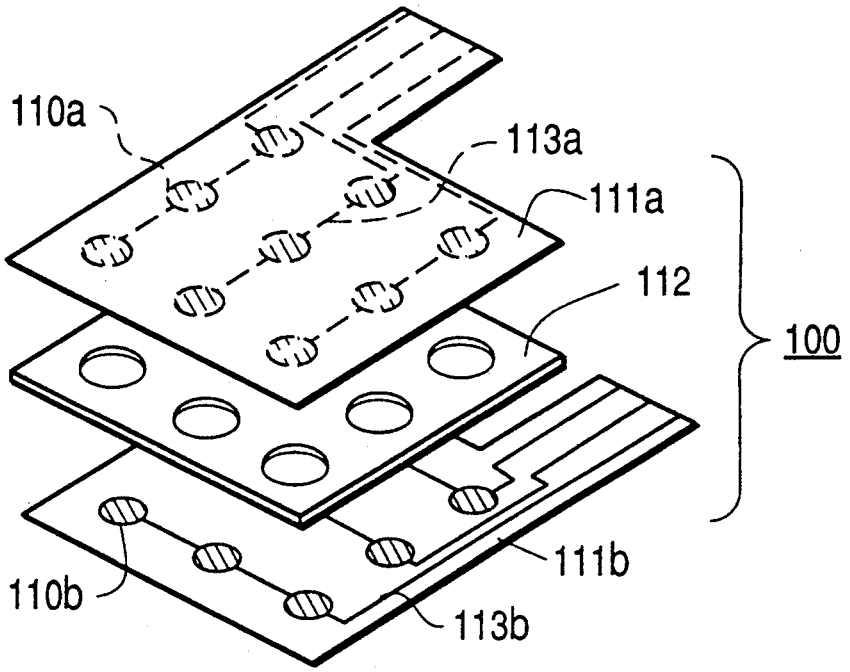
FIG. 1 PRIOR ART
FIG. 1 is a perspective view of a membrane sheet type switch used in a push switch of the present invention.
Figure 2A:
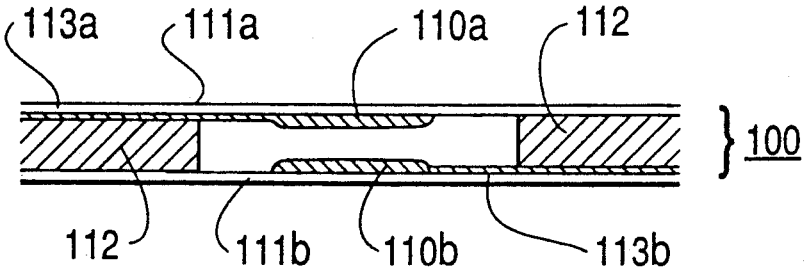
FIG. 2(a) PRIOR ART
FIG. 2(*a*) is a cross sectional view of the membrane sheet type switch of FIG. 1 in a non-operating state and FIG. 2(*b*) shows the same switch when the contacts are closed.
Figure 2B:
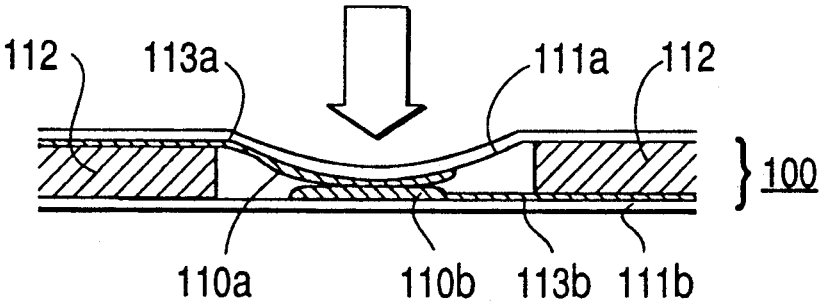
FIG. 2(b) PRIOR ART
Figure 3A:
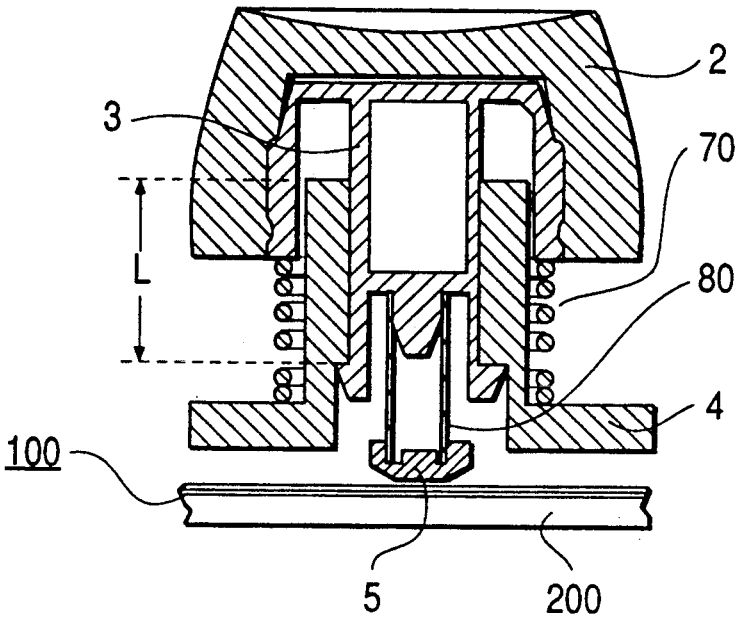
FIG. 3(a) PRIOR ART
FIGS. 3(*a*) and 3(*b*) are cross sectional views of exemplary push-button switches of the prior art.
Figure 3B:
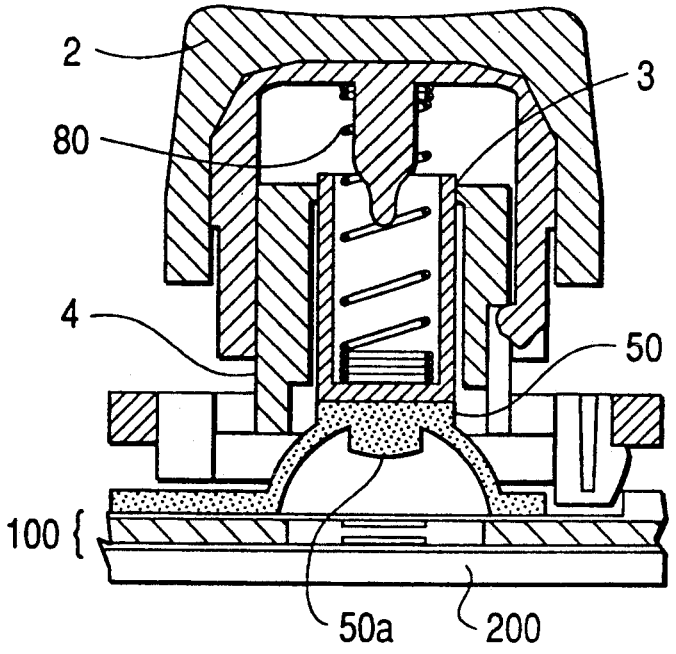
FIG. 3(b) PRIOR ART
Figure 4A:
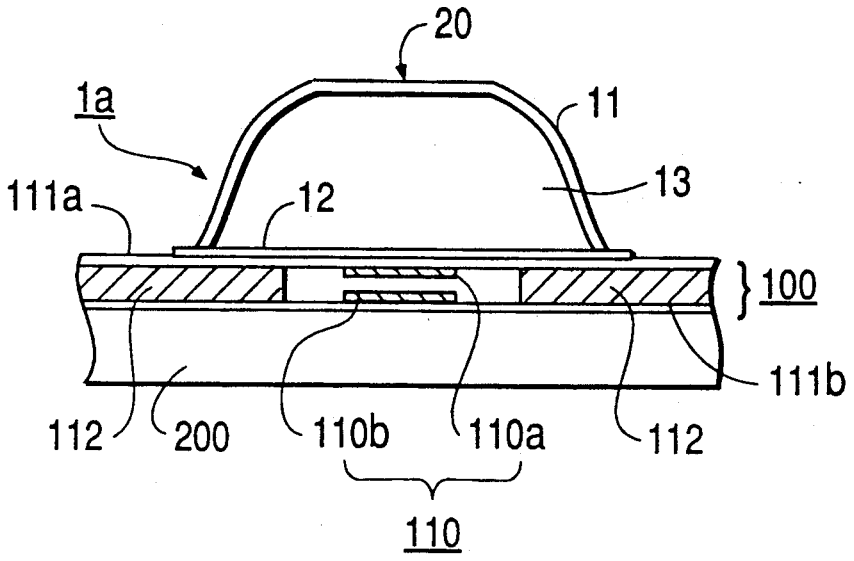
FIGS. 4(*a*) and 4(*b*) are cross sectional views of a first embodiment of a push switch of the present invention in a non-operating state and in a depressed state by a finger respectively, in which a domed actuator of an airtight enclosure is used, a gas being enclosed therein.
Figure 4B:
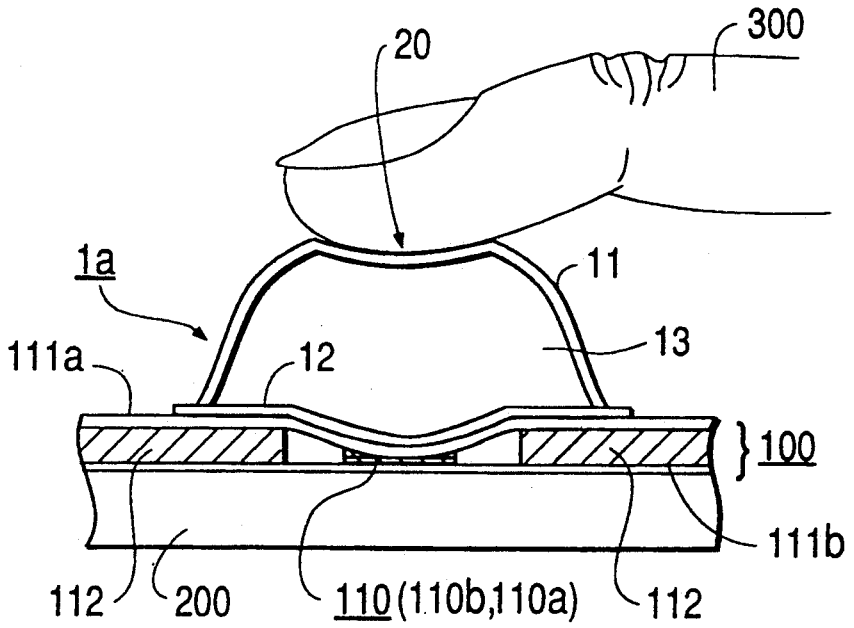

FIGS. 4(*a*) and 4(*b*) show a first embodiment of a push switch in accordance with the present invention, in which FIG. 4(*a*) shows a cross section in a non-operating state and FIG. 4(*b*) shows a cross section when the push switch is depressed.

A switching-element assembly 100 of the push switch is disposed on a support panel 200 of iron, aluminum or the like. The switching-element assembly 100 comprises an upper sheet 111*a* and a lower sheet 111*b* of a flexible film of polyester or the like, each having respectively a wiring pattern and a contact 110*a*, 110*b*. These are printed thereon using an ink of Ag (silver) or C (carbon). A spacer 112 having holes at the corresponding positions to the contacts when two sheets are stacked together.

On contact portion 110 of the switching-element assembly 100, a domed actuator 1*a* is disposed, the domed actuator being composed of a top member 11 and a bottom flat member 12, both being airtightly sealed together and made of an elastic film made of, for example, polyethylene film or silicone rubber. A gas is enclosed, in other words, sealed therein. The top member 11 has a thickness of about 1 mm and the bottom member 12 has a thickness of about 0.3 to 0.5 mm. Conveniently two members 11 and 12 may be joined together by an adhesive enclosing air of atmospheric pressure.

The top member 11 of the actuator assembly may have a spherical surface or a top flat finger-touch portion 20 with a conical side-wall portion for easy touch feeling by a finger. The dimensions of the domed actuator 1*a* are properly determined for easy handling.

Now, as shown in FIG. 4(*b*), when the finger touch portion 20 of the domed actuator 1*a* is depressed by a finger tip 300, the gas (air) pressure comprised therein rises and uniformly depresses the upper sheet 111*a* lying thereunder. Since the spacer 112 has a hole at the position of the contact portion of the switching-element assembly, an upper sheet 111*a* is bent downwardly and the contact 110*a* makes a contact with contact 110*b*, resulting in closing a circuit connected to the contacts. In this operation, the finger touch portion 20 can be depressed further downwardly after the contacts are closed. Therefore, the function of switching action can be achieved halfway in the downward finger stroke movement.

When the depression force of finger tip 300 is removed from the finger touch portion 20, the domed actuator 1*a* returns to its original shape shown in FIG. 4(*a*) due to an elastic pressure caused by the enclosed gas and the elastic top member 11 itself, and the contacts 110*a* and 110*b* are opened.

In this embodiment, since the actuator assembly has a simple structure such as the domed actuator 1*a*, a push switch having a very light weight can be realized without a slider, housing, springs and etc.

The compressed gas pressure enclosed in the domed actuator 1*a* gives a repulsion force to the finger and this will also give a comfortable key touch feeling. It is generally known that a repulsion force which increases proportionally with a stroke length during depression will give a comfortable key-touch feeling. The repulsion force in this embodiment changes in accordance with the volume of the sealed gas. In this case, though the repulsion force does not increase linearly and proportionally with an increase of the stroke length, however, it is confirmed that the repulsion force increases monotonically and gives a comfortable feeling.

The amount of the repulsion force sensed by the finger tip 300 can be arbitrarily set up by changing the pressure of the sealed gas, or by changing the material of the airtight elastic film 11 to another material having a different elasticity other than polyethylene or silicone rubber.

Figure 5:
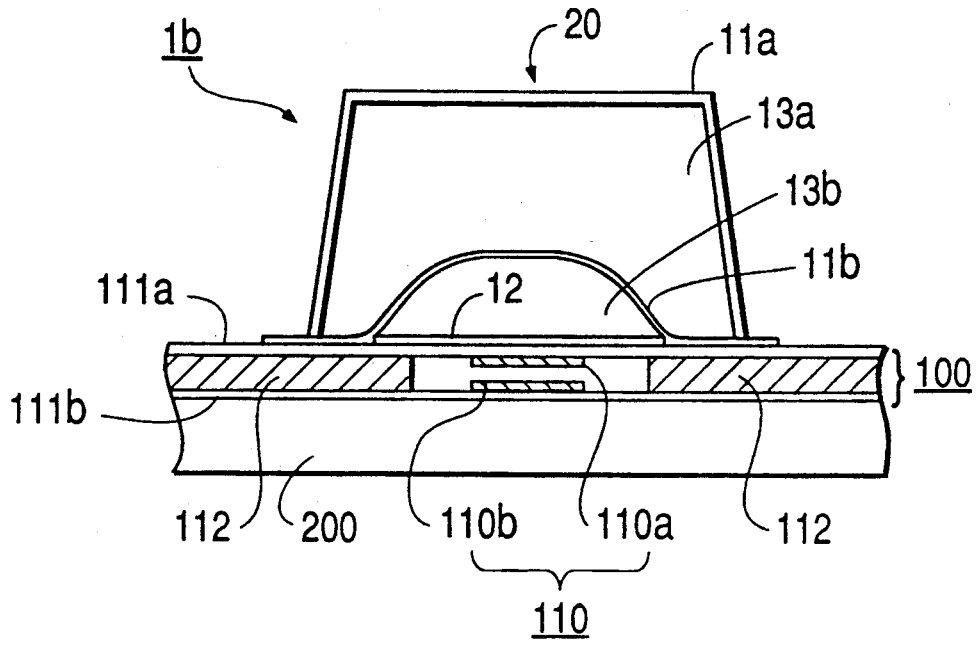
FIG. 5 is a cross sectional view of a second embodiment of the present invention as a modified version of the actuator assembly of FIGS. 4(*a*) and 4(*b*), in which an actuator assembly comprises two airtight enclosures.

FIG. 5 shows a second embodiment of the present invention.

A domed actuator 1*b* is formed by elastic films 11*a*, 11*b* and 12, thereby two enclosures 13*a* and 13*b* being formed partitioned by the elastic film 11*b*. A first enclosure 13*a*, or in other word, a compartment is airtightly formed by elastic films 11*a* and 11*b* and is filled with a first gas. A second enclosure 13*b* is also airtightly formed by elastic films 11*b* and 12 and is filled with a second gas. Other parts are the same as those explained in the previous embodiment. Two enclosures 13*a* and 13*b* may be separately formed and stacked together.

Since the domed actuator 1*b* is divided into two airtight enclosures, gas pressures of the first gas and the second gas can be determined differently from each other, resulting in obtaining a more comfortable key touch feeling. For example, when the pressure of the first gas is set to be lower than that of the second gas, the necessary stroke length for closing the switching-element assembly 100 can be made longer.

Figure 6:
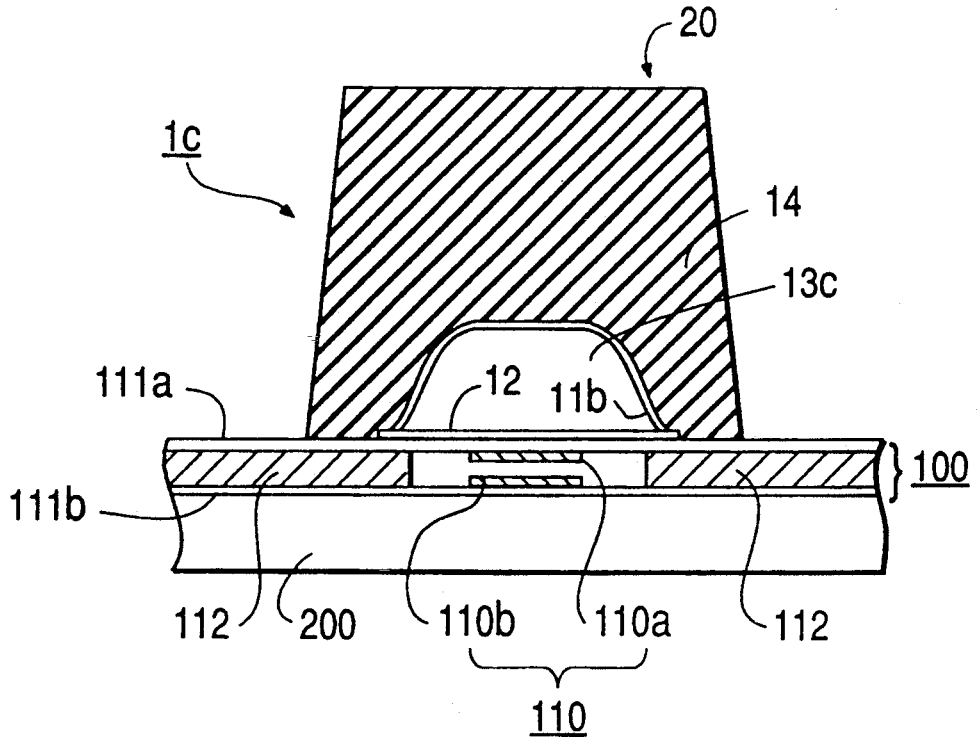
FIG. 6 is a cross sectional view of a third embodiment of the present invention as another modified version of the actuator assembly, in which the actuator assembly comprises a main body of elastic foaming material and an airtight enclosure embedded in the main body.

FIG. 6 shows a third embodiment of the present invention.

A domed actuator 1*c* comprises a main actuator body 14 of elastic foaming material such as polyurethane sponge (called Moltoplen), and is formed in the dome shape. The actuator may have other shapes such as a truncated square cone in which the top surface thereof forms a finger touch portion 20. An airtight enclosure 13*c* formed by elastic films 11*b* and 12 enclosing a gas and embedded in the main actuator body 14. The airtight enclosure 13*c* can be formed in a similar way as the domed actuator 1*a* of FIG. 4(*a*). Other parts are the same as those previously explained.

In this embodiment, the main actuator body 14 of elastic foaming material is substituted for the enclosure 13*a* of FIG. 5. This embodiment makes it possible to obtain a longer stroke length than that shown in FIG. 5.

The shapes and sizes of the main actuator body 14 and the domed enclosure 13*c* are appropriately determined depending on the requirements of a push switch.

Figure 7A:
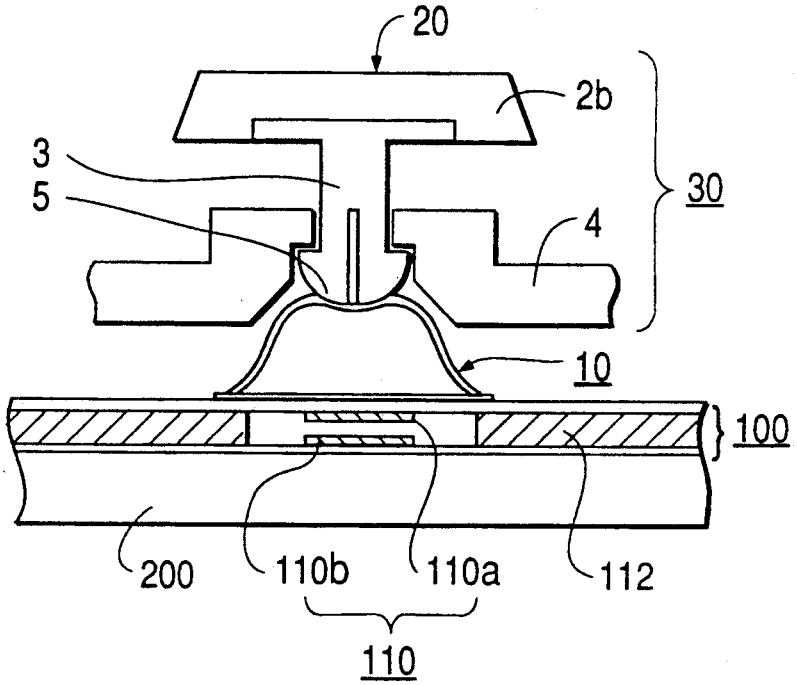
FIGS. 7(*a*) and 7(*b*) are cross sectional views of a fourth embodiment of the present invention, in which a slider assembly is added to the structure of the domed actuator assembly of FIGS. 4(*a*) and 4(*b*), respectively.
Figure 7B:
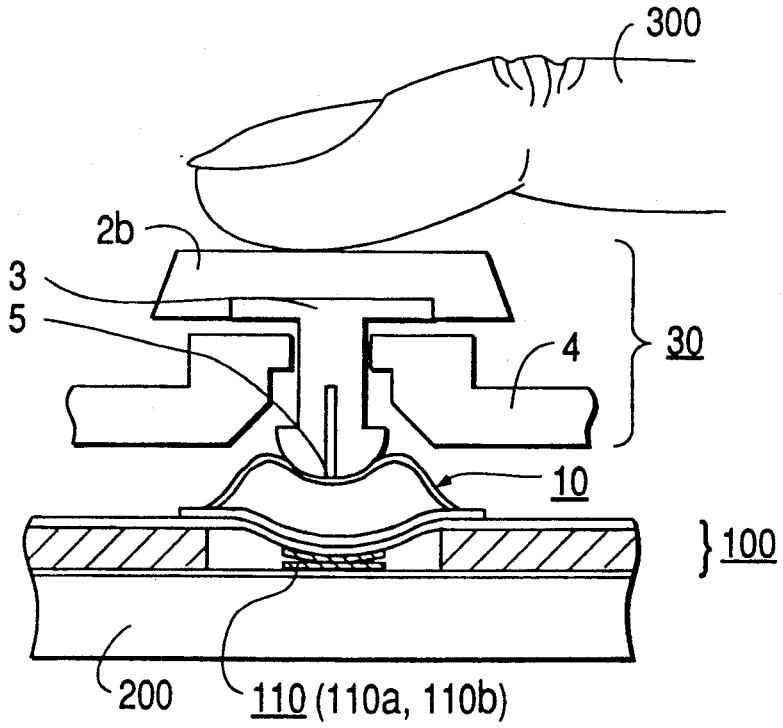

FIGS. 7(*a*) and 7(*b*) show a fourth embodiment of the present invention, in which FIG. 7(*a*) shows a cross section in a non-operating state and FIG. 7(*b*) shows a cross section when a key-top is depressed.

In FIGS. 7(*a*) and 7(*b*), an actuator assembly 10 may be anyone selected from those (1*a* to 1*c*) used in FIGS. 4(*a*), 5, 6, however, herein the domed actuator 1*a* of FIG. 4(*a*) is used in these two figures.

On the actuator assembly 10, a slider assembly 30 is arranged in the manner that a slider 3 slides up and down through a hole of a housing 4, a key-bottom 5 of the slider 3 contacting with the actuator assembly 10. At the top of the slider 3, a key-top 2*b* having a finger touch portion 20 is fixed, then the push switch of FIGS. 7(*a*) and 7(*b*) can be operated with the same feeling experienced in using the conventional key-tops of a keyboard.

The housing 4 is fixed to a support panel 200 by screw means or insertion means (not shown). Other parts except the slider assembly 30 are the same as explained previously, therefore, the explanation thereof is omitted.

As shown in FIG. 7(*b*), when finger tip 300 depresses the finger touch portion 20, the key-bottom 5, i.e., the bottom end of the slider 3, depresses the domed actuator 10 downwardly, and the gas pressure sealed therein rises and gives a uniform pressure onto a contact portion 110 arranged below. As a result, the contact 110*a* is depressed downwardly, closing the contacts and performing a switching action.

In the prior art push switch having thin thickness and light weight, the slider assembly, which directly depresses the contact portion 110 of the switching-element assembly 100, has been utilized.

However, in this embodiment, the contact portion is depressed indirectly by the slider 3, intervening the actuator assembly 10 therebetween. Therefore, if the gas pressure is properly selected, the contacts can be made to close before the slider 3 goes down at the lower end of the stroke, and the slider 3 can be depressed further against a repulsive force caused by the elastic actuator assembly 10. Therefore, the switching action can be achieved halfway during the stroke movement.

Figure 8A:
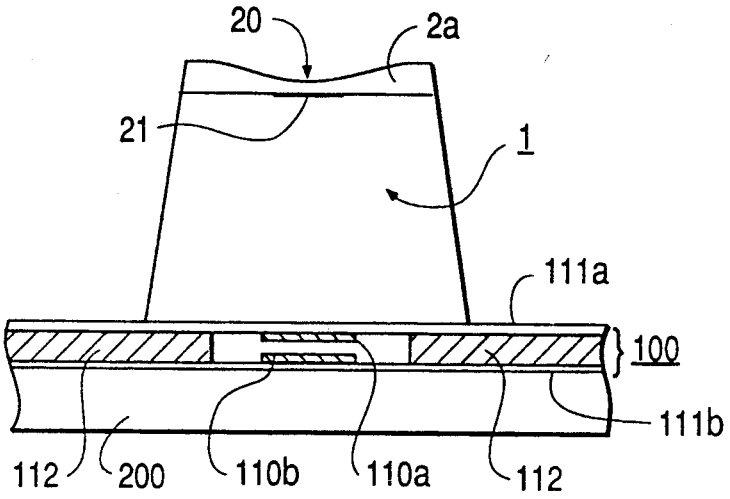
FIGS. 8(*a*) and 8(*b*) are respectively a schematic cross sectional view and a perspective view of a fifth embodiment of the present invention when a key-top is added on the actuator assembly of the present invention.
Figure 8B:
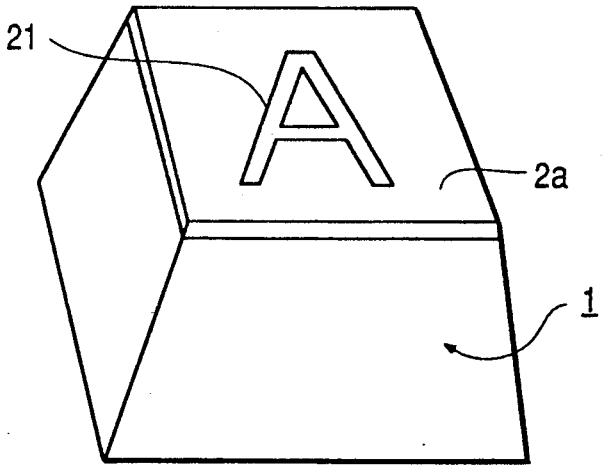

FIGS. 8(*a*) and 8(*b*) show a fifth embodiment of the present invention, in which FIG. 8(*a*) shows a cross section and FIG. 8(*b*) shows a bird's-eye view of an actuator assembly.

In the figures, a domed actuator 1 may be anyone among those (1*a*, 1*b*, 1*c*) used in FIGS. 4(*a*), 5, 6. A key-top 2*a* is made of vinyl chloride and the like, having transparency and being formed in a hard thin sheet, and it has a concave top surface. On the bottom surface thereof, a mark 21 such as a character and a symbol is printed, in which the mark is printed in the manner of inverting front-back sides such that, when the mark is seen from the top side through the transparent key-top 2*a*, the normal mark pattern can be seen. The domed actuator 1 and key-top 2*a* are fixed together by adhesive as shown in the figures.

The embodiment is suitable for push switches used in a keyboard. Generally, since a key-top of the keyboard has a character or symbol designating a function thereof, there is a problem that frequent finger touches onto the key-top will erase the printed mark in a long use. The embodiment can solve the above problem using the same printing method with a low cost.

Figure 9A:
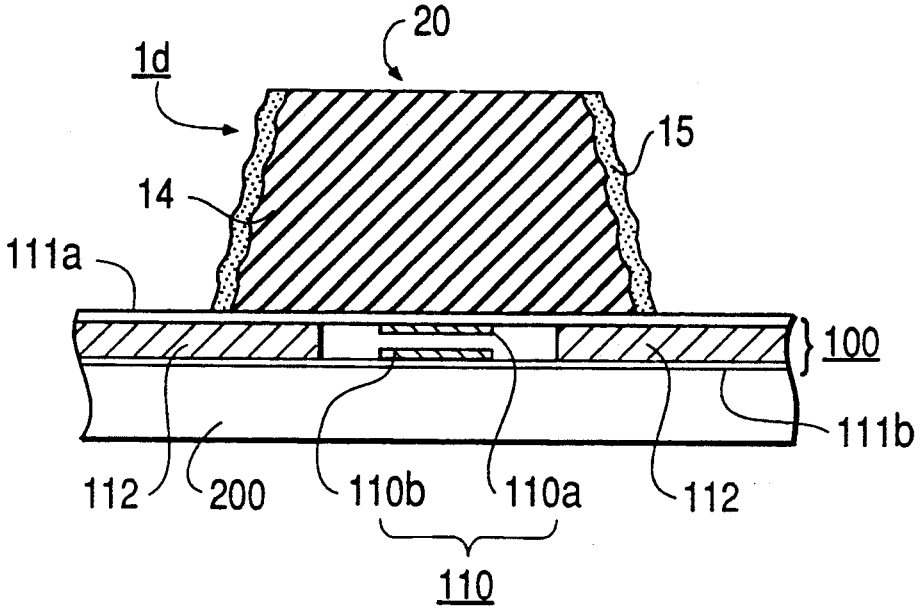
FIGS. 9(*a*) and 9(*b*) are cross sectional views of a sixth embodiment of the present invention in a non-operating state and in a depressed state respectively, in which an actuator assembly comprises an actuator body of elastic foaming material and a sidewall of another elastic material.
Figure 9B:
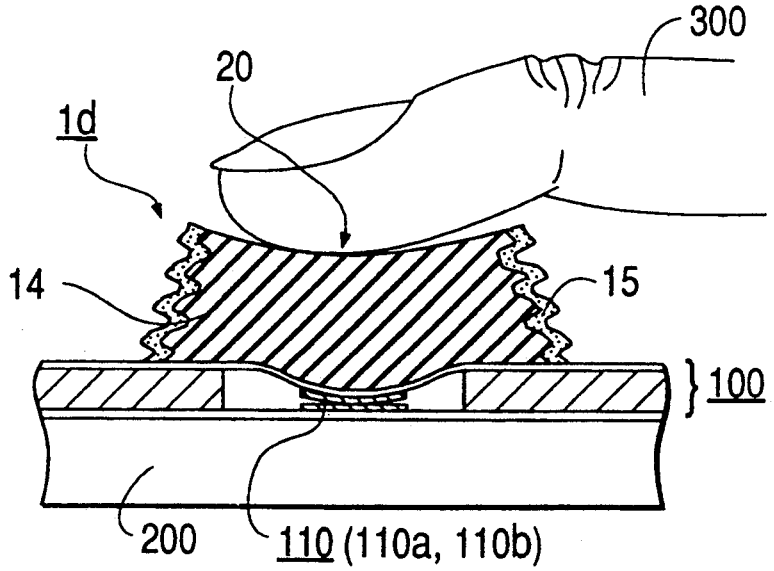

FIGS. 9(*a*) and 9(*b*) show a sixth embodiment of the present invention, in which FIG. 9(*a*) shows a cross section in a non-operating state and FIG. 9(*b*) shows a cross section when a push switch is depressed.

A domed actuator 1*d* comprises an elastic body 14 of foaming material such as polyurethane sponge (called Moltoplen), and a side support elastic member 15 which is made of flexible material but has an enough strength to stand by itself. Other parts are the same as those used in the previous embodiments, therefore explanation thereof is omitted.

Japanese Unexamined Patent Publications SHO 57-55020 previously explained in the related arts, the actuator used therein has no support member on the sidewall thereof. Therefore, if the actuator of the foaming material is too elastic, it wobbles during the depressing operation, and a smooth stroke can not be obtained.

On the contrary, the domed actuator of this embodiment has a side support elastic member 15 surrounding the elastic body 14, and the side support member is made of elastic material which still has enough strength to stand by itself. Therefore, even when the elastic body 14 does not have enough strength to stand by itself, the domed actuator assembly does not totter, and the depressing operation is smooth and stable.

As the material for the side support elastic member 15, a plastic material having a proper hardness such as vinyl chloride, polystyrene etc., and further silicone rubber may be used. Further, when the side support member 15 is formed in a corrugated shape, metal can be used as the material for the side support member 15.

Whatever material is used therefor, it is important that the side support elastic member is formed in the way that it is easily movable in the vertical direction (stroke direction) but it is hard to move in the lateral direction.

Figure 10A:
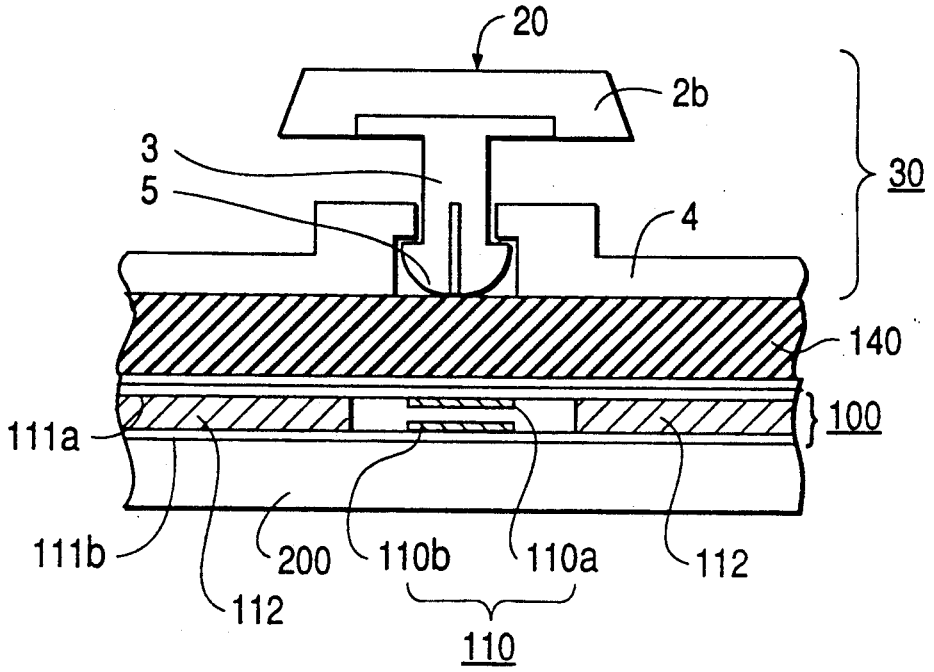
FIGS. 10(*a*) and 10(*b*) are cross sectional views of a seventh embodiment of the present invention in a non-operating state and in a depressed state, respectively, in which a slider assembly is added to an actuator assembly of elastic foaming material.
Figure 10B:
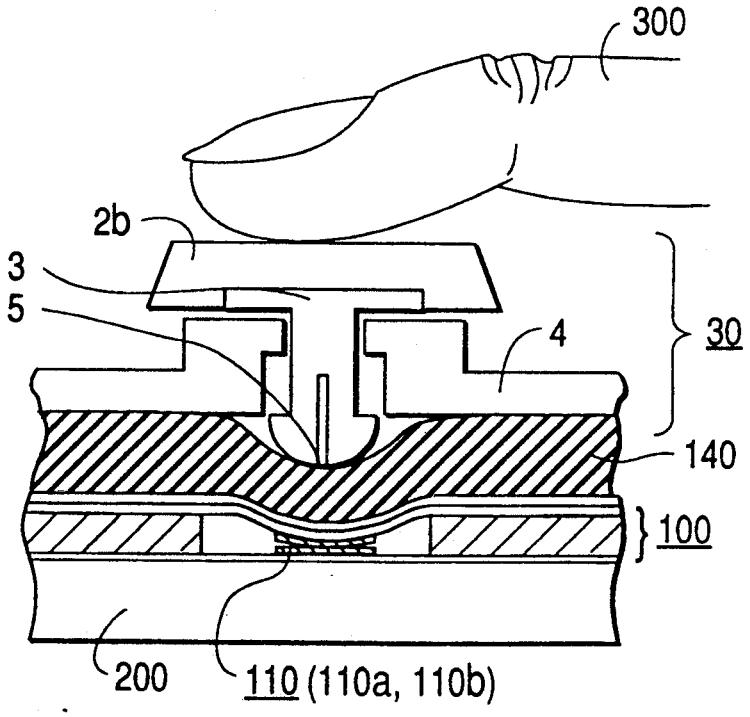

FIGS. 10(*a*) and 10(*b*) show a seventh embodiment of the present invention, in which FIG. 10(*a*) shows a cross section in a non-operating state and FIG. 10(*b*) shows a cross section when a key-top is depressed.

In the figures, a flat elastic member 140 is of, for example, elastic foaming material such as polyurethane sponge (called Moltoplen), disposed on a switching-element assembly 100. On the upper surface of the flat elastic member 140 and above a contact portion 110 of the switching-element assembly 100, a slider assembly 30 is arranged, in which a slider 3 penetrates through a hole provided in a housing 4, the slider 3 being movable up and down therethrough, and a key-bottom 5 thereof contacting with the top surface of the elastic member 140. On the top of the slider 3, a key-top 2*b* is fixed thereto as shown in the figures, and thus the push switch can be operated with the same feeling as that obtained by a conventional push-button switch.

In this embodiment, the key-bottom 5 of the slider 3 does not depress directly the contact portion 110 of the switching-element assembly 100, but the contact portion 110 is depressed indirectly via the flat elastic member 140 as in the case for FIGS. 7(*a*) and 7(*b*). By a proper selection of an elasticity of the flat elastic member 140, the contacts can be closed before the key-bottom goes down at the bottom end of the stroke. And the slider 3 can further go down against a repulsive force of the flat elastic member 140, therefore, the switching action can be performed halfway of the stroke movement.

Figure 12A:
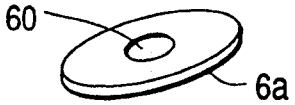
FIGS. 12(*a*) and 12(*b*) are perspective view showing the pressure dispersion plate used in FIGS. 11(*a*) and 11(*b*), respectively.
Figure 12B:
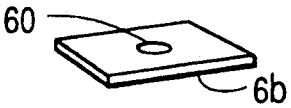
Figure 11A:
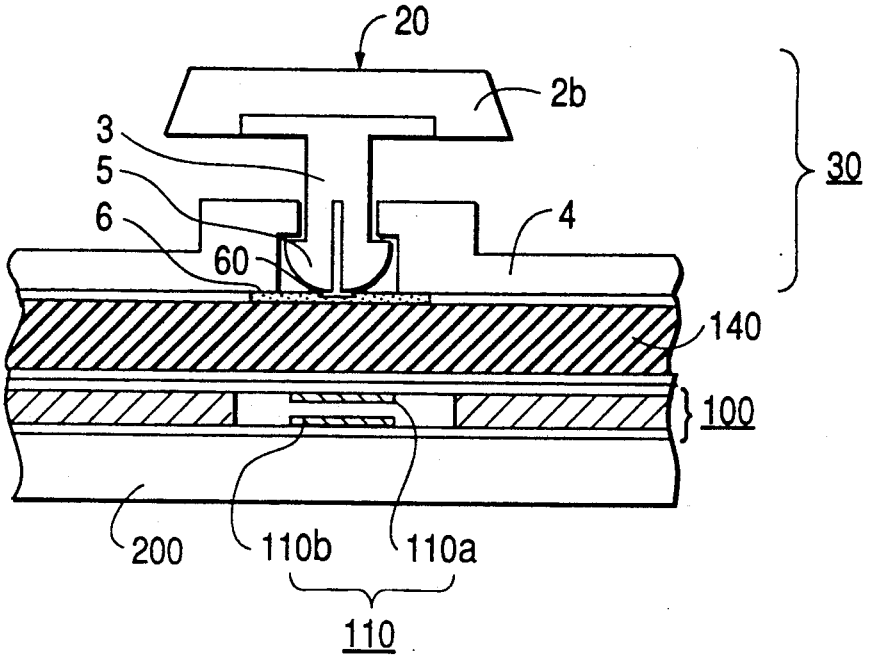
FIGS. 11(*a*) and 11(*b*) are cross sectional views of an eighth embodiment of the present invention in a non-operating state and in a depressed state, respectively, in which a pressure dispersion plate is added between the slider assembly and the actuator assembly of FIGS. 10(*a*) and 10(*b*)
Figure 11B:
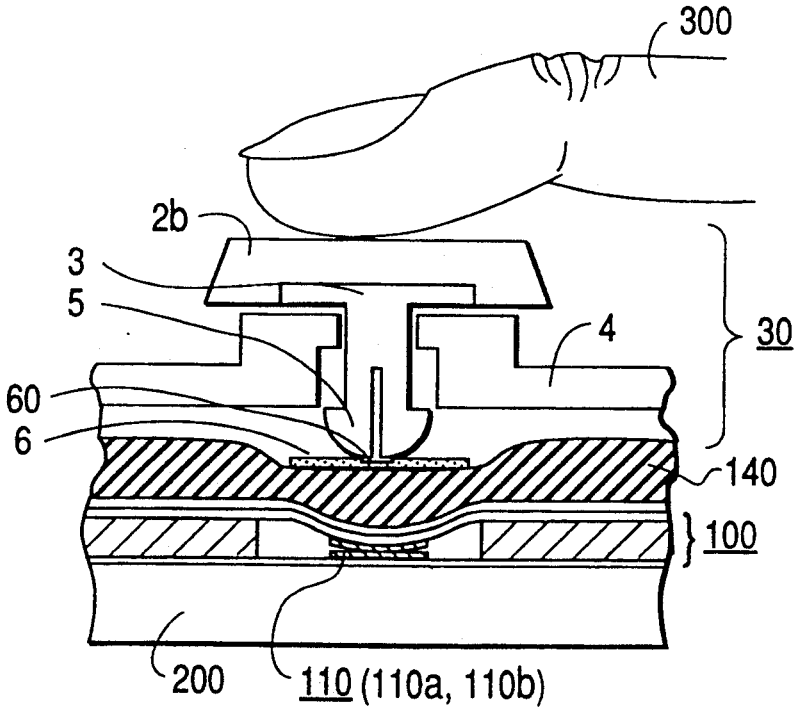

FIGS. 11(*a*) and 11(*b*) show an eight embodiment of the present invention, in which FIG. 11(*a*) shows a cross section in a non-operating state, and FIG. 11(*b*) shows a cross section when a key-top is depressed, in which a pressure dispersion plate 6 is added to the structure of FIGS. 10(*a*) and 10(*b*). FIGS. 12(*a*) and 12(*b*) show an example of a pressure dispersion plate which is a special feature of this embodiment.

The pressure dispersion plate 6 is of plastic material such as polystyrene, or metal such as aluminum and the like. In this embodiment, the pressure dispersion plate 6 is arranged between a key-bottom 5 and a flat elastic member 140, therefore, the depressing pressure of the key-bottom 5 is not concentrated on a small area but distributed over a nearby region. As the result, even if the axial line of a slider 3 is inconsistent with that of a contact portion 110 after assembly of the push switch, the depression force is effectively transmitted to the contact portion 110.

The above merit is particularly effective when a plurality of the push switches are used in order to form a keyboard. As the result of using the pressure dispersion plate 6, the key-bottom 5 does not depress directly the flat elastic member 140, its life is remarkably improved, resulting in enhancing the reliability of the apparatus using the same.

It is further effective to provide means 60 for preventing a position shift of the pressure dispersion plate 6 by forming such as a dimple, hole, protrusion, etc. as shown in FIGS. 12(*a*) and 12(*b*). Needless to say, the shape of the pressure dispersion plate 6 may be any form selected among circular, elliptic, square, rectangular, and polygonal forms. FIG. 12(*a*) shows a circular form and FIG. 12(*b*) shows a square form.

Throughout the explanation on all the embodiments, structures of a single push switch are taken up and explained. However, when a plurality of push switches according to the present invention are utilized, a matrix switch array or a keyboard is easily formed, in which the support panel 200, the switching-element assembly 100 and the flat elastic member 140 used in the embodiments are modified into an integrated structure to cover the plurality of push switches.

Even for the domed actuator, a plurality of domed actuators in some types are formed all together in a continuous form by an integral molding technique, if necessary. This will improve machining and assembling efficiencies.

The actuator assembly including all types of domed actuators 1*a* to 1*d* and 10 of the embodiments is fixed on the switching-element assembly 100. However, the actuator assembly may be arranged such that it can be removed or replaced with another type of the actuator assembly when a sticky adhesive or insertion mechanism is used in fixing. By replacing the domed actuator with that of a different type having a different characteristic, the keyboard having a different key touch feeling, which meets an individual's taste, can be obtained.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims, rather than the foregoing description, and all changes which come within the meaning and range of equivalence of the claims are, therefore, to be embraced therein.

What is claimed is:

1. A push switch comprising:

a switching-element assembly; and an actuator assembly arranged on the switching-element assembly, said switching-element assembly including a first fixed contact and a second movable contact vertically arranged, the second movable contact being movable toward the first fixed contact and making contact with the first fixed contact when depressed by said actuator assembly, said actuator assembly including a dome-shaped airtight enclosure having a dome-shaped top surface formed of an elastic film and a flat bottom surface formed of an elastic film and a gas enclosed therein, the top surface is secured to the bottom surface thereby forming the dome-shaped airtight enclosure, the bottom surface of the dome-shaped airtight enclosure being arranged with respect to said second movable contact to depress said second movable contact when a depression force is applied to the top surface of the dome-shaped airtight enclosure.

2. A push switch as recited in claim 1, wherein said elastic film of a domed shape comprises a top member having a spherical surface and a bottom flat member.

3. A push switch as recited in claim 2, wherein said elastic film is formed of one of thermoplastic resin and silicone rubber.

4. A push switch as recited in claim 2, wherein said airtight enclosure further comprises a partition member dividing said airtight enclosure into first and second airtight subenclosures, said gas comprising a first gas in said first subenclosure and a second gas in said second subenclosure.

5. A push switch as recited in claim 4, wherein a gas pressure in each of said first and second subenclosures is different.

6. A push switch as recited in claim 4, wherein said first and second airtight subenclosures are formed of one of thermoplastic resin and silicone rubber.

7. A push switch as recited in claim 4, further comprising a support panel, wherein said switching-element assembly and said actuator assembly are arranged on said support panel.

8. A push switch as recited in claim 4, wherein said actuator assembly further comprises a slider assembly disposed thereon, said slider assembly comprising:

a fixed housing having a vertical hole;

a slider vertically movable in said vertical hole; and a key-top fixed on said slider, the slider having a bottom end contacting the top surface of said airtight enclosure, whereby depression of said key-top is transformed into the depression force on said airtight enclosure.

9. A push switch as recited in claim 4, wherein said actuator assembly further comprises a key top made of transparent material and fixed on the top surface of said actuator assembly, said key top having a printed mark on the bottom surface thereof.

10. A push switch as recited in claim 4, wherein arrangement of said actuator assembly on said switching-element assembly is replaceable.

11. A matrix switch array comprising a plurality of push switches as recited in claim 4 is arranged on a support panel.

12. A push switch as recited in claim 1, wherein said airtight enclosure is embedded in another airtight main enclosure of an elastic film having a domed shape and enclosing another gas, the bottom surface of the first airtight enclosure being exposed and contacting with upper surface of the switching-element assembly, thereby said airtight first enclosure and another main enclosure forming said actuator assembly.

13. A push switch as recited in claim 12, wherein each gas pressure in said two enclosures is different from each other.

14. A push switch as recited in claim 12, wherein the material of said two airtight enclosures is either thermoplastic resin or silicone rubber.

15. A push switch as recited in claim 12, wherein said switching-element assembly and actuator assembly are arranged on a support panel.

16. A push switch as recited in claim 12, wherein said actuator assembly further comprises a key top made of transparent material and fixed on the top of the actuator assembly, said key top having a printed mark such as character and symbol on the bottom surface thereof.

17. A push switch as recited in claim 12, wherein arrangement of said actuator assembly on said switching-element assembly is replaceable.

18. A matrix switch array comprising a plurality of push switches as recited in claim 12 is arranged on a support panel.

19. A push switch as recited in claim 1, wherein said actuator assembly further comprises a main body of an elastic foaming material having a domed shape, wherein said airtight enclosure is embedded in said main body of an elastic foaming material having a domed shape, the bottom surface of the airtight enclosure being exposed and contacting an upper surface of said switching-element assembly, so that said airtight enclosure and said main body form said actuator assembly.

20. A push switch as recited in claim 19, wherein said elastic foaming material of the main body is polyurethane sponge.

21. A push switch as recited in claim 19, further comprising a support panel, wherein said switching-element assembly and said actuator assembly are arranged on said support panel.

22. A push switch as recited in claim 12, wherein said actuator assembly further comprises a slider assembly disposed thereon, the slider assembly further comprising a fixed housing having a vertical hole, a slider vertically movable in said hole, and a key-top fixed on the slider, the bottom end of the slider contacting with the top surface of the domed actuator, whereby depression of the key-top is transformed into the depression force onto said domed actuator assembly.

23. A push switch as recited in claim 19, wherein said actuator assembly further comprises a slider assembly disposed thereon, said slider assembly comprising:

a fixed housing having a vertical hole;

a slider vertically movable in said vertical hole; and a key-top fixed on said slider, the slider having a bottom end contacting the top surface of said airtight enclosure, whereby depression of said key-top is transformed into the depression force on said airtight enclosure.

24. A push switch as recited in claim 19, wherein said actuator assembly further comprises a key top made of transparent material and fixed on the top surface of said actuator assembly, said key top having a printed mark on the bottom surface thereof.

25. A push switch as recited in claim 19, wherein arrangement of said actuator assembly on said switching-element assembly is replaceable.

26. A matrix switch array comprising a plurality of push switches as recited in claim 19 is arranged on a support panel.

27. A push switch as recited in claim 1, further comprising a support panel, wherein said switching-element assembly and said actuator assembly are arranged on said support panel.

28. A push switch as recited in claim 1, wherein said actuator assembly further comprises a slider assembly disposed thereon, said slider assembly comprising:

a fixed housing having a vertical hole;

a slider vertically movable in said vertical hole; and a key-top fixed on said slider, the slider having a bottom end contacting the top surface of said airtight enclosure, whereby depression of said key-top is transformed into the depression force on said airtight enclosure.

29. A push switch as recited in claim 1, wherein said actuator assembly further comprises a key top made of transparent material and fixed on the top surface of said actuator assembly, said key top having a printed mark on the bottom surface thereof.

30. A push switch as recited in claim 1, wherein arrangement of said actuator assembly on said switching-element assembly is replaceable.

31. A matrix switch array comprising a plurality of push switches as recited in claim 1, arranged on a support panel.

* * * * *